US006182752B1

(12) United States Patent
Smith, Jr. et al.

(10) Patent No.: US 6,182,752 B1
(45) Date of Patent: Feb. 6, 2001

(54) MULTI-PORT CEMENTING HEAD

(75) Inventors: Sidney K. Smith, Jr., Conroe; William B. Preece, The Woodlands, both of TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/115,360

(22) Filed: Jul. 14, 1998

(51) Int. Cl.[7] ..... E21B 23/00
(52) U.S. Cl. ..... 166/70; 166/75.15; 137/268
(58) Field of Search ..... 166/75.15, 70; 137/268

(56) References Cited

U.S. PATENT DOCUMENTS

| | | | | |
|---|---|---|---|---|
| 2,713,909 | * | 7/1955 | Baker | 166/70 |
| 3,146,477 | * | 9/1964 | Bergman et al. | 15/104.06 |
| 3,403,729 | | 10/1968 | Hickey . | |
| 3,759,284 | | 9/1973 | Crowley et al. | 137/268 |
| 4,491,177 | | 1/1985 | Baugh | 166/75 R |
| 4,694,900 | | 9/1987 | Behrens | 166/75.1 |
| 4,782,894 | * | 11/1988 | Lafleur | 166/70 |
| 4,917,176 | | 4/1990 | Shimada et al. | 165/95 |
| 5,012,845 | * | 5/1991 | Averette | 141/329 |
| 5,040,603 | * | 8/1991 | Baldridge | 166/291 |
| 5,095,988 | | 3/1992 | Bode | 166/291 |
| 5,188,178 | | 2/1993 | Noyes | 166/310 |
| 5,435,390 | | 7/1995 | Baugh et al. | 166/285 |
| 5,590,713 | | 1/1997 | Baugh et al. | 166/53 |
| 5,833,002 | | 11/1998 | Holcombe | 166/291 |

* cited by examiner

*Primary Examiner*—Hoang Dang
(74) *Attorney, Agent, or Firm*—Duane, Morris & Heckscher LLP

(57) ABSTRACT

A plug-dropping head capable of dropping balls or plugs or other objects is disclosed. The plug-dropping head has a compact design with a cylinder having multiple chambers for storage of plugs and/or balls. The device can be actuated manually or automatically, locally or remotely, to rotate the cylinder to present a different bore in alignment with a flowpath through the housing. An exterior signal indicates that the object has fallen through the device. An indexing feature assures alignment of the individual bores in the cylinder which contain a plug or wiper with the main passage through the tool. Flow can be maintained through the tool as the cylinder is rotated. Rotation of the cylinder allows an obstruction device in the flowpath to move out of the way to allow the ball or plug to drop when sufficient alignment is reached.

18 Claims, 4 Drawing Sheets

MULTI-PORT CEMENTING HEAD

FIELD OF THE INVENTION

The field of this invention relates to devices which can be used to drop objects into a wellbore, particularly balls or plugs used during the process of cementing liners.

BACKGROUND OF THE INVENTION

Devices have been used to drop balls or plugs into the wellbore, generally as part of a cementing process for a liner or casing. Balls can be dropped to actuate external packers or liner hangers, while wiper plugs are dropped during the cementing process, with one of the major purposes to wipe the cement from the casing or liner. In this patent application, reference will be made to plug-dropping head with the understanding that different types of objects can be dropped or inserted through it and the reference to plug-dropping head is meant for convenience to be all-inclusive. In situations that required multiple drops of plugs, plug-dropping heads in the past have been stacked vertically, one on top of the other, such that the assemblies could grow to a dimension of nearly 20 ft. or more. Typical of such devices is one made by Nodeco, designated as a top-drive cementing head for dual darts. This assembly is indicated as being approximately 2400 mm long. Other companies have made plug-dropping heads to drop multiple plugs and, in general, all these prior designs have vertically stacked similar or identical assemblies on top of each other so that plugs are arranged one on top of the next and can be dropped sequentially, starting with the lowermost plug. Since these plug-dropping heads are frequently inaccessible to the rig floor, devices have been developed to remotely actuate these plug-dropping heads so that one or more plugs can be dropped when desired. Patents which illustrate the remote actuation of plug-dropping heads are U.S. Pat. Nos. 5,435,390 and 5,590,713. These patents also incorporate the use of vertical stacking of plugs.

The problem with the prior art designs is that the assemblies were overly long, expensive to build, and time-consuming to assemble and effectively operate, primarily due to inaccessibility. What is needed is a compact device which could be simply operated which would also allow for dropping multiple plugs and/or balls. One of the objectives of the present invention is to provide such a compact design which could hold a multiplicity of plugs and/or balls in discrete chambers in a cylinder rotating about a vertical axis. Thus, the objective of a compact design is achieved with the present invention in view of its configuration. Another objective of the present invention is to provide an indexing feature which assures the desired alignment for dropping the plugs. Another objective of the present invention is to signal visually to rig personnel that a plug or ball or other object has been dropped. Yet another object is to allow actuation of the device with ongoing circulation and to configure the device in such a manner that circulation continues as the device is actuated. Yet another object is to construct the device in the manner so as to transmit torque therethrough without stressing threaded connections. Yet another objective is to provide a simple design which is not only compact but also reliable in operation. Those and other objectives of the present invention will become more apparent to those of skill in the art from a review of the preferred embodiment which is described below.

SUMMARY OF THE INVENTION

A plug-dropping head capable of dropping balls or plugs or other objects is disclosed. The plug-dropping head has a compact design with a cylinder having multiple chambers for storage of plugs and/or balls. The device can be actuated manually or automatically, locally or remotely, to rotate the cylinder to present a different bore in alignment with a flowpath through the housing. An exterior signal indicates that the object has fallen through the device. An indexing feature assures alignment of the individual bores in the cylinder which contain a plug or wiper with the main passage through the tool. Flow can be maintained through the tool as the cylinder is rotated. Rotation of the cylinder allows an obstruction device in the flowpath to move out of the way to allow the ball or plug to drop when sufficient alignment is reached.

DETAILED DESCRIPTION OF THE PREFERRED EMBODIMENT

Figure 1:
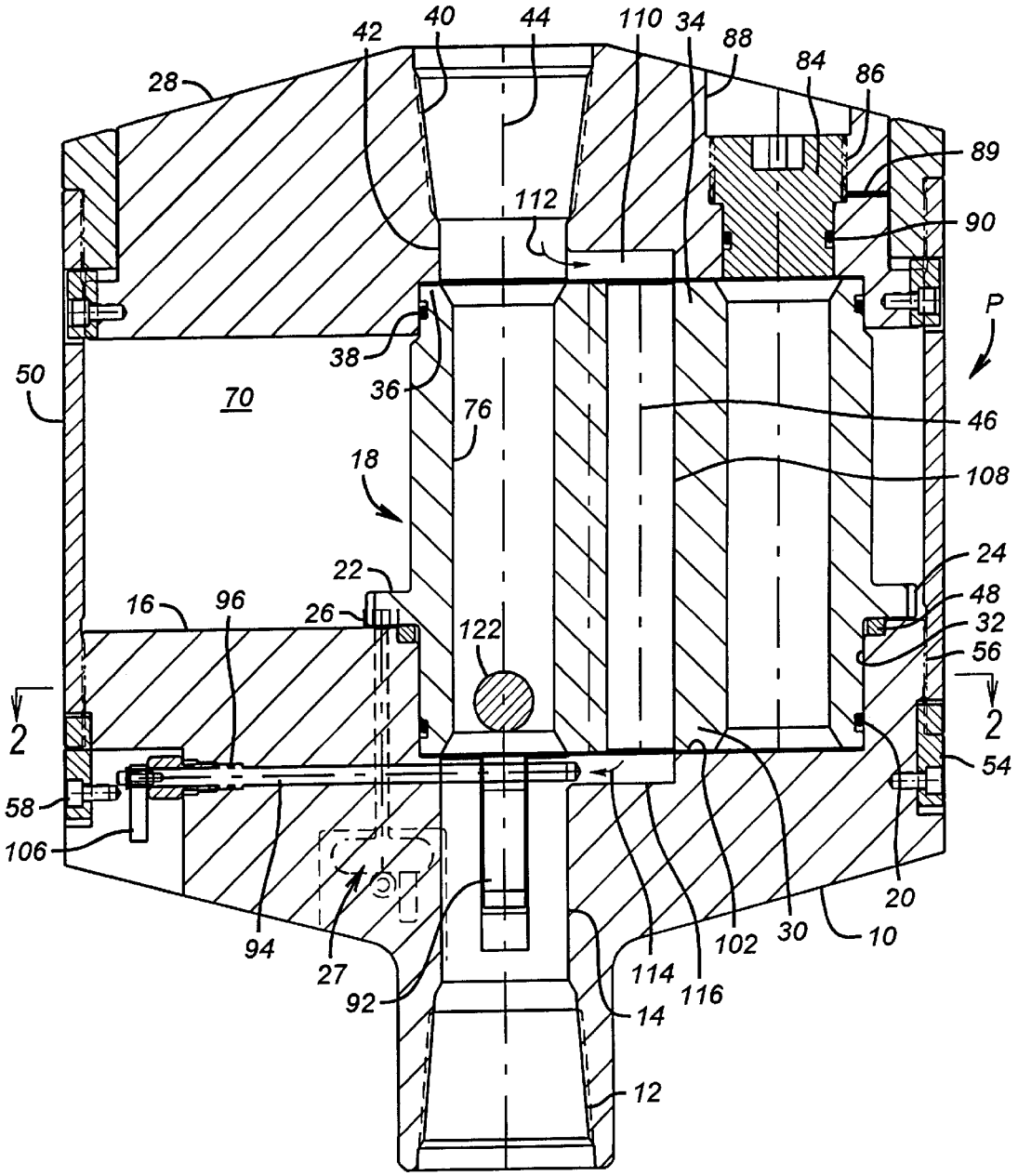
FIG. 1 is a sectional elevation of the device showing a ball the instant before it is to drop through the device when the support flapper has rotated out of the way.

The plug-dropping head P is shown in FIG. 1 to be made of several components. A lower housing 10 has a threaded outlet 12. Threaded outlet 12 continues as bore 14. The lower housing 10 has a top surface 16 which accepts the cylinder 18 in a sealing arrangement accomplished by O-ring or any other type of seal 20. The cylinder 18 has a circumferential ring 22 also seen in FIG. 2. Circumferential ring 22 has outer teeth 24 which mesh with gear 26. Gear 26 is connected to crank 27 so that when crank 27 is rotated, the cylinder 18 is rotated with respect to the lower housing 10 and the upper housing 28. It should be noted that the depicted technique for rotating the cylinder 18 with respect to the housings 10 and 28 is intended to be schematic and to also represent numerous alternative ways of accomplishing the relative rotational movement of the cylinder 18. For example, cylinder 18 can be moved by a motor powered electrically, pneumatically, or hydraulically, connected to a drive to cylinder 18. A stepper motor can be used which will accurately rotate the cylinder 18 the precise amount for alignment of the next ball or plug. Those skilled in the art will appreciate other techniques that can be employed to accomplish the rotation of cylinder 18. While the lower end 30 of cylinder 18 extends into a receptacle 32 in lower housing 10, the upper end 34 of cylinder 18 extends into a receptacle 36 of upper housing 28. As previously stated, seal 20 seals adjacent the lower end 30 of cylinder 18, while seal 38 seals adjacent the upper end 34 of cylinder 18. Seal 38 is located within receptacle 36 of upper housing 28.

Upper housing 28 has a threaded inlet 40 which extends into bore 42, which is in alignment with bore 14. It can be readily seen that the central axis 44 of the plug-dropping head P is offset from the central axis 46 of the cylinder 18. This is more clearly seen in FIG. 2 where the central axes are marked in the plan view.

Referring again to FIG. 1, a soft metallic or nonmetallic thrust bearing 48 is installed in the lower housing 10 to facilitate the rotation of the cylinder 18 with respect to the lower housing 10 and upper housing 28. The thrust bearing 48 can be made of brass or bronze or PTFE or any other compatible material which will facilitate the relative rotation while having sufficient strength to support the weight of the assembly of cylinder 18.

Figure 3:
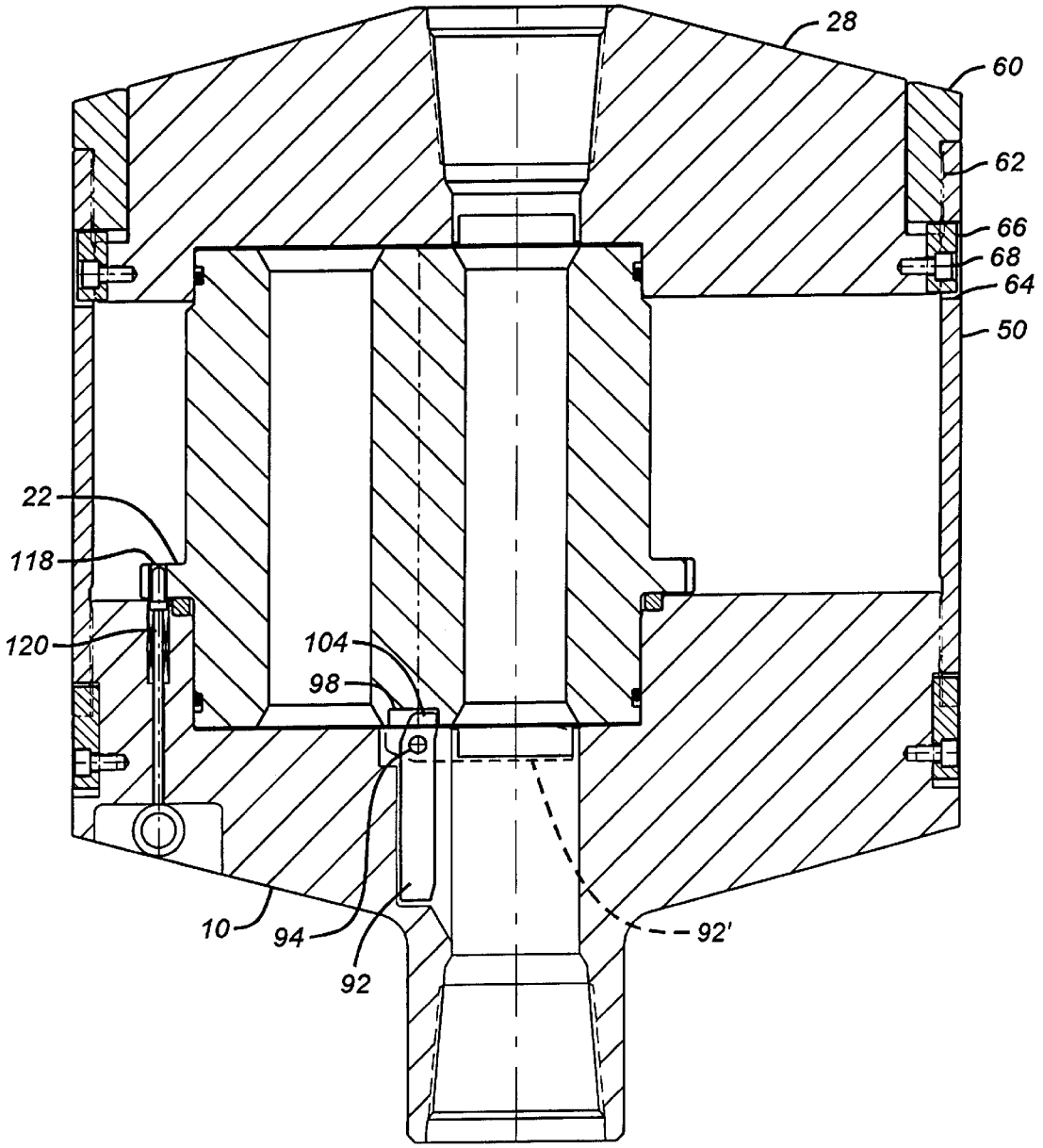
FIG. 3 is the view along lines 3—3 of FIG. 2.
Figure 4:
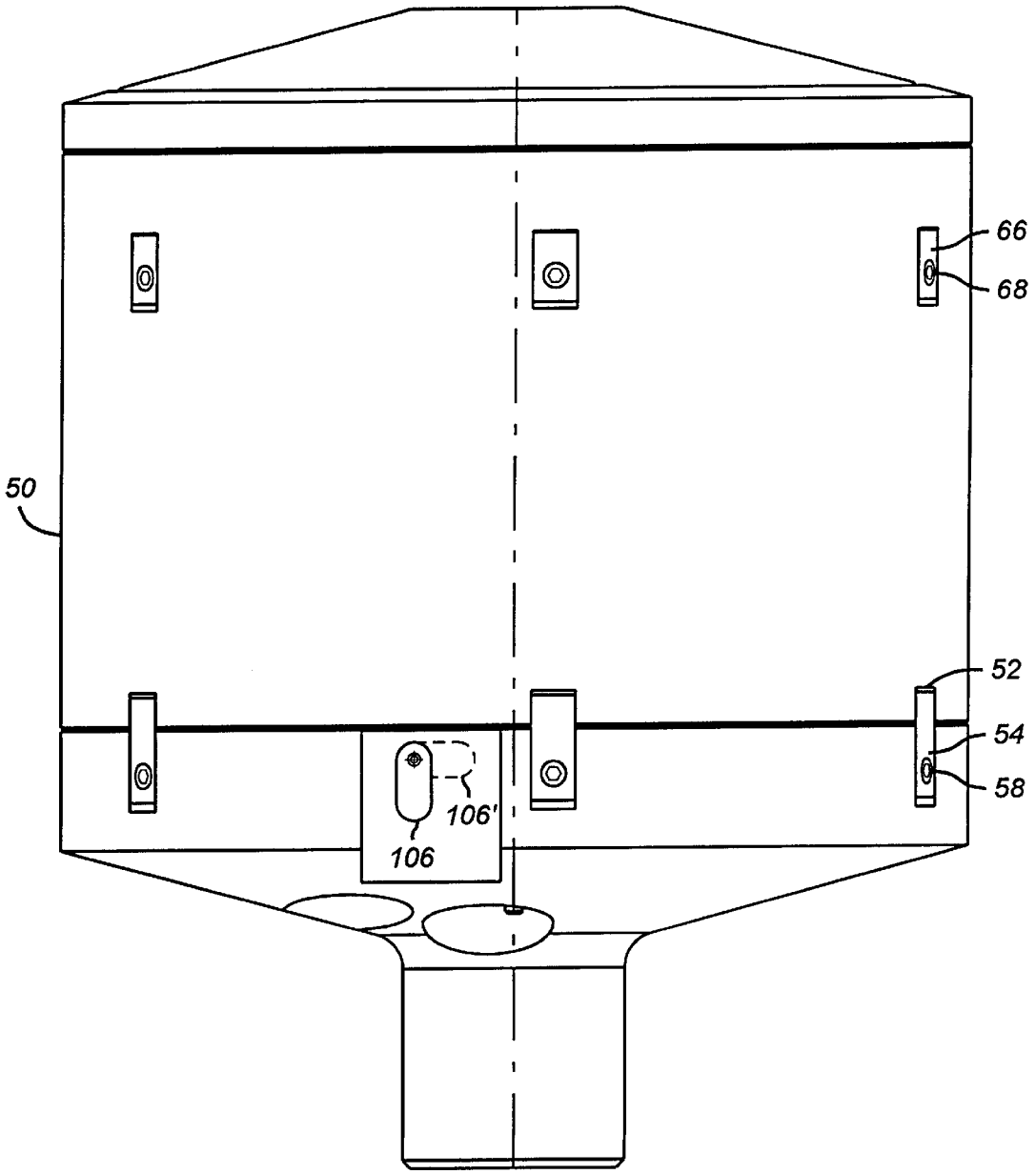
FIG. 4 is an external elevational view of the apparatus of the present invention.

A cover 50 has a series of slots 52 as shown in FIG. 4. Tabs 54 extend into slots 52 after the cover 50 has been attached to the lower housing 10 at thread 56. A bolt 58 holds the tab 54 in slot 52. The upper housing 28, as shown in FIG. 3, is secured to the cover 50 by nut 60 via threaded connection 62. Cover 50 has a series of windows 64 through which a lug 66 held by bolt 68 is inserted and fastened. The purpose of lug 66 is to transmit torque from upper housing 28 to cover 50 and to avoid placing applied torque on the threaded connection 62. Similarly, the tabs 54 act to transfer torque from the cover 50 to the lower housing 10 and avoid placing applied torque on the threaded connection 56. Those skilled in the art will appreciate that during the cementing procedure, the liner being cemented may be rotated and the string supporting the liner will be connected to the plug-dropping head P through the connections 12 and 40 such that a turning force applied at the rig will be transmitted through the plug-dropping head P in some installations when the liner is being rotated.

As previously stated, the operation of the plug-dropping head P can be automated so that a remote signal can be received at the plug-dropping head P and electronics or other control mechanisms can be actuated to accomplish the turning of the cylinder 18 when desired. A space 70 exists between the cover 50 and the cylinder 18 due to the offset mounting of the cylinder 18 with respect to the axis 44 in which the control mechanisms and/or drive mechanisms can also be installed.

Figure 2:
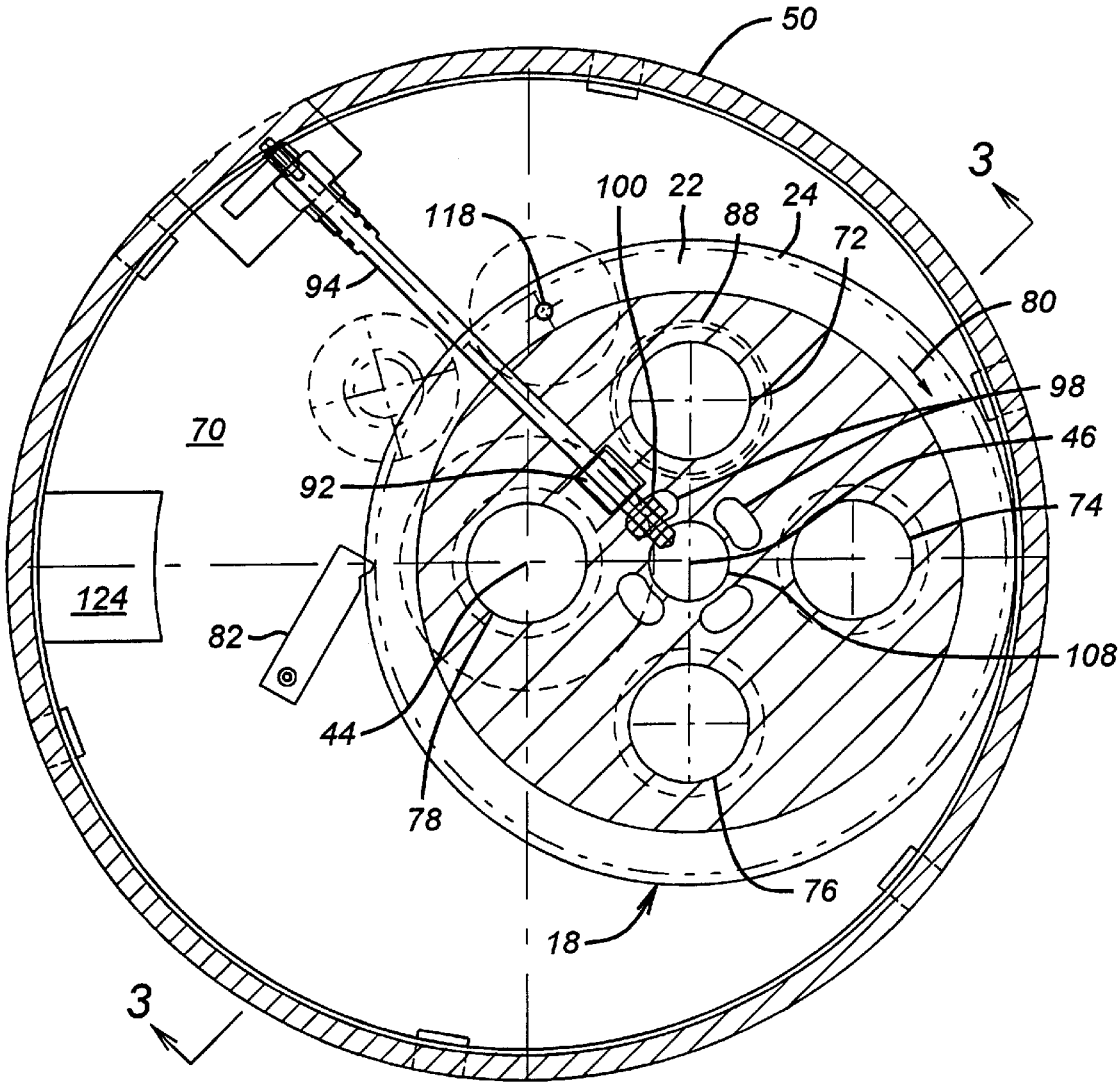
FIG. 2 is the view seen along lines 2—2 of FIG. 1.

Referring to FIG. 2, the cylinder 18 is shown to have bores 72, 74, 76, and 78. These bores have centerlines which are preferably equidistant from axis 46. Although four bores are shown, other configurations having greater or fewer numbers of bores in cylinder 18 can be employed without departing from the spirit of the invention. In the plan view of FIG. 2, bore 78 is in alignment with bores 14 and 42. Bore 78 shows clear which can be the position during the pumping of the cement or other fluids. Ultimately, due to the rotation of the cylinder 18, bores 76, 74 and 72, respectively, can come into sufficient alignment with bores 14 and 42 so as to allow a ball or plug therein to drop through bore 14. Looking at FIG. 2, the cylinder 18 rotates in a clockwise direction as shown by arrow 80. A ratchet 82, shown schematically in FIG. 2, permits only rotation in the direction of arrow 80 without reverse rotation. Those skilled in the art will appreciate that other types of ratcheting devices or their equivalents can ensure unidirectional rotation of the cylinder 18 without departing from the spirit of the invention. Similarly, rotation can be counterclockwise without departing from the spirit of the invention.

Referring again to FIG. 1, a plug 84 is secured by threads 86 in bore 88. In the preferred embodiment, bore 88, as shown in FIG. 2, is located adjacent the bore 78 such that balls or plugs can be loaded into bores 72, 74, and 76 in conjunction with clockwise rotation of the cylinder 18 before any of the bores 72, 74 and 76 are brought into alignment with bores 14 and 42, respectively, on the lower housing 10 and upper housing 28. A bleed passage 89 is provided in upper housing 28 such that the threaded connection 86 continues the engagement of plug 84 to upper housing 28 as O-ring or any other type of seal 90 passes above bleed passage 89 to allow pressure to vent out of the plug-dropping head P through passage 88 before the removal of plug 84. Plug 84 is removed for loading of balls or plugs into the bores such as 72, 74 and 76.

Another feature of the present invention is the signaling feature. Referring to FIG. 3, a flapper 92, which acts as an obstruction device, is shown in two positions. Flapper 92 pivots about rod 94 whose end can be seen in FIG. 3. Rod 94 is shown more clearly in FIGS. 1 and 2. Rod 94 extends through lower housing 10, with seal 96 preventing the escape of pressure in the plug-dropping head P. The lower end 30 of the cylinder 18 has a series of oval-shaped recesses 98, shown in FIG. 2. In the preferred embodiment, recesses 98 are oriented 90° from each other to correspond to alignment of bores 72,74,76 or78 with bores 14 and 42. Rod 94 has a cam 100 which normally rides on the bottom surface 102 of cylinder 18. As any one of the bores illustrated in FIG. 1 come into alignment with bores 14 and 42, the oval-shaped opening or recess 98 presents itself adjacent the cam 100, thus allowing the weight of flapper 92 to initiate 90° rotational motion as tab end 104 rotates into recess 98, as shown in FIG. 3. At other times, recess 98 is rotated away from tab end 104, causing a pivoting of the flapper 92 with rod 94. Thus, referring to FIG. 3, the flapper 92 is shown in the open position where a ball or plug can be dropped and the same flapper 92' is also shown in FIG. 3 in the closed position. The flapper 92' remains in the closed position until there is near alignment or complete alignment between a given bore in the cylinder 18 and bores 14 and 42. Attached to the end of rod 94 is indicating flag 106 which is oriented downwardly toward threaded outlet 12 when the flapper 92 is in the open position shown in FIG. 3. FIG. 4 also illustrates the flag 106 indicating to rig personnel that a ball or plug has dropped through bore 14. The other position of flag 106 is 90° rotated from the position shown in FIG. 4 and indicated as 106' in FIG. 4.

Those skilled in the art will appreciate that although a 90° rotating flapper 92 has been illustrated as the device to selectively retain a ball or plug prior to its being dropped through bore 14, other devices can be used, and the primary objective of the assembly just described is to give rig personnel a signal that a ball or plug has become aligned with the bore 14 and the ball or plug has been dropped due to removal of a support which would keep the ball or plug from falling through bore 14. Thus, a 90° rotating plug or a series of fingers could also be used as long as they were structurally sound to prevent the ball or plug from passing therethrough under circulating pump pressure internal to the plug-dropping head P. It should be noted that there is no need for the flapper 92 to close off the passage and, in fact, it is desirable to maintain circulation through the plug-dropping head P, even with the flapper 92' in the closed position. Along those lines, to ensure the ability to flow sufficiently, particularly while cylinder 18 rotates, a bore 108 is provided in cylinder 18 along central axis 46. In the preferred embodiment, the upper housing 28 has a cutaway 110 which allows flow through bore 42 to go in the direction of arrows 112 and 114 to accomplish flow through bore 108 back into bore 14, while at the same time flow is going straight through from bore 42 through the aligned bore in cylinder 18 into bore 14. Those skilled in the art will appreciate that the configuration shown in FIG. 2 will always allow flow through bore 108 of cylinder 18 through the recess 110 and its equivalent recess, 116 in bottom housing 10. While the recesses have been shown in upper housing 28 and lower housing 10, they could as easily be located in the cylinder 18 itself. The recesses can be configured for continuous flow through bore 108 or they can be sloped or tapered so that flow through bore 108 only occurs for a short period of time during rotation of cylinder 18 and effectively is significantly reduced or eliminated when a bore in cylinder 18 comes into alignment with bores 42 and 14.

FIG. 3 also indicates an indexing feature which ensures proper alignment of a given bore in cylinder 18 with bores 14 and 42. Circumferential ring 22 has a series of holes 118, one of which is shown in FIG. 2. Mounted to the lower housing 10 is a spring-loaded indexing pin 120. In the manual version shown in FIGS. 2 and 3, the pin 120 is pulled down before the crank 27 is rotated. Once there has been some angular rotation of cylinder 18, the pin 120 is released and cranking continues with crank 27. Ultimately, when the next bore in cylinder 18 is in alignment with bores 14 and 42, the pin 120 pops into hole 118 to prevent further rotation. Those skilled in the art will appreciate that other indexing devices, including those that are automatically operated, are also within the purview of the invention. Thus, especially if the cylinder 18 is motor-driven, a host of devices can be used to stop motor operation after a predetermined angular displacement of cylinder 18. This can be accomplished by using, for example, a stepper motor to control the rotation of cylinder 18. It can also be accomplished by putting targets on cylinder 18 and sensing the passage of such targets upon a predetermined rotation of cylinder 18. The important thing is that there is a mechanism, be it manual or automatic, to ensure that movement of cylinder 18 stops when a given bore in cylinder 18 comes into sufficient alignment with bores 14 and 42.

Those skilled in the art will appreciate that the figures are truly schematic in several senses. The illustration of a manual crank 27 is intended to be sufficiently schematic so as to encompass a power-driven cylinder 18 which is either locally controlled or remotely controlled from a location removed from the plug-dropping head P. The mechanism involving rod 94 is also intended to be schematic for alternative systems which retain a plug or ball from falling into bore 14 until there is sufficient alignment with the bore in cylinder 18. Further, the schematic representation of the assembly involving flag 106 with rod 94 is also intended to broadly illustrate numerous alternative techniques of giving visual, audible or other signals to rig personnel that rotation of cylinder 18 has occurred and the ball or plug has dropped.

It should be noted that FIG. 1 illustrates the presence of a ball 122 (which is normally dropped before plugs) suspended in bore 76 just instantaneously before it drops through bore 14 since the flapper 92 is in the open position. Thus, for example, one application of the plug-dropping head P can be the placement of a ball in bore 76 with a plug in bore 74 and bore 72 such that rotation in the direction of arrow 80 will result in first a ball being dropped and the next two rotations will allow plugs to be dropped. The plugs are not shown in the drawings for clarity, and the design of the plugs themselves is not a part of this invention.

Those skilled in the art will now appreciate that what has been demonstrated is a compact design for a plug-dropping head P which can be operated completely manually or automatically, locally or from a remote location and, in a very compact design, can allow rig personnel to drop one or more balls and/or one or more plugs in a very simple design which will operate reliably.

Also illustrated in FIG. 2 is a counter-balancing weight 124. Since the cylinder 18 is mounted off-center from axis 44 and may be rotated during cementing, the counterbalancer 124 counterbalances the offset mounting of the cylinder 18 so that vibration is reduced or eliminated. Those skilled in the art will appreciate that the cylinder 18 is mounted in an offset manner on axis 46 so that its various bores can be rotated into a central position in alignment with longitudinal axis 44. Other type of delivery systems can be used instead of cylinder 18 with bores thereon. Instead of a cylinder 18, a ring with internal dividers can be used such that turning the ring on its vertical axis will position the next ball or plug for dropping. A belt with dividers can also be used so that rotating the belt about a vertical axis will position successive balls or plugs for dropping.

The compact design of the plug-dropping head P allows faster rig-up due to its lightweight nature and its compact design. The design is fairly simple and the sealing components, such as seals 90, 38, 20, and 96 can be easily replaced, even by rig personnel, if necessary, at the location. The design incorporates a feature so as not to stress threaded connections 56 and 62 when torques are transmitted through the plug-dropping head P. A signaling system is also incorporated and the number and size of the bores in cylinder 18 can be varied to accommodate a particular application.

The foregoing disclosure and description of the invention are illustrative and explanatory thereof, and various changes in the size, shape and materials, as well as in the details of the illustrated construction, may be made without departing from the spirit of the invention.

What is claimed is:

1. A device for inserting at least one object into a wellbore, comprising:

a housing having a passage therethrough, said passage connectable to a wellbore for insertion of objects therein;

a retention device supported by said housing to hold at least one object to be inserted in the wellbore and to selectively position it in said passage of said housing for insertion into the wellbore;

an obstruction device in said passage of said housing which prevents release of an object from said retention device until a predetermined alignment between said passage in said housing and the object in said retention device has been achieved.

2. The device of claim 1, wherein:

said retention device holds a plurality of objects which can sequentially be sufficiently aligned with said passage in said housing for insertion into the wellbore.

3. The device of claim 2, further comprising:

an external signal device to give an indication that said retention device has positioned an object therein in sufficient alignment with said passage in said housing so that the object can be inserted into the wellbore.

4. The device of claim 2, wherein:

said device further comprises a rotatably mounted member configured to separately retain the objects for insertion, such that rotation of said member sequentially brings successive objects in sufficient alignment with said passage in said housing to allow their insertion.

5. The device of claim 4, wherein:

said member comprises a cylinder with multiple bores;

said cylinder is motor-driven.

6. The device of claim 5, wherein:

said motor is actuated remotely to facilitate insertion of objects when said housing is mounted inaccessible to personnel.

7. A device for inserting at least one object into a wellbore, comprising:

a housing having a passage therethrough, said passage connectable to a wellbore for insertion of objects therein;

a retention device supported by said housing to hold at least one object to be inserted in the wellbore and to selectively position it in said passage of said housing for insertion into the wellbore;

said retention device holds a plurality of objects which can sequentially be sufficiently aligned with said passage in said housing for insertion into the wellbore;

an obstruction device in said passage of said housing which prevents release of an object from said retention device until a predetermined alignment between said passage in said housing and the object in said retention device has been achieved;

said obstruction device rotates so as to no longer obstruct said passage in said housing when said predetermined alignment is reached;

said rotation operates an external signal to indicate said predetermined alignment.

8. A device for inserting at least one object into a wellbore, comprising:

a housing having a passage therethrough, said passage connectable to a wellbore for insertion of objects therein;

a retention device supported by said housing to hold at least one object to be inserted in the wellbore and to selectively position it in said passage of said housing for insertion into the wellbore;

said retention device holds a plurality of objects which can sequentially be sufficiently aligned with said passage in said housing for insertion into the wellbore;

said device further comprises a rotatably mounted member configured to separately retain the objects for insertion, such that rotation of said member sequentially brings successive objects in sufficient alignment with said passage in said housing to allow their insertion;

said member comprises a cylinder with multiple bores;

said cylinder is mounted with its longitudinal centerline offset from the centerline of said housing and in a sealed relationship thereto;

said bores which retain an object are located at a predetermined radius from the centerline of said cylinder.

9. The device of claim 8, wherein:

said cylinder further comprises at least one flow passage therethrough which is in fluid communication with said passage in said housing at least a portion of the time that said cylinder is rotated.

10. The device of claim 8, further comprising:

a weight mounted to said housing to offset said off-center mounting of said cylinder with respect to said housing when said housing is rotated.

11. The device of claim 10, wherein:

said housing comprises an upper and lower housing with said cylinder in between, said upper and lower housings each connected to a cover in a manner which transmits applied torque through said cover without going through a threaded connection holding said cover to said upper or lower housings.

12. A device for inserting at least one object into a wellbore, comprising:

a housing having a passage therethrough, said passage connectable to a wellbore for insertion of objects therein;

a retention device supported by said housing to hold at least one object to be inserted in the wellbore and to selectively position it in said passage of said housing for insertion into the wellbore;

said retention device holds a plurality of objects which can sequentially be sufficiently aligned with said passage in said housing for insertion into the wellbore;

said device further comprises a rotatably mounted member configured to separately retain the objects for insertion, such that rotation of said member sequentially brings successive objects in sufficient alignment with said passage in said housing to allow their insertion;

said member comprises a cylinder with multiple bores;

said housing comprises an obstruction device held in an obstruction position by the position of said cylinder relative to said housing, said obstruction device movable out of said passage when rotation of said cylinder has brought a bore thereon into sufficient alignment with said passage to allow the object to be inserted into the wellbore.

13. The device of claim 12, wherein:

a signaling device on said housing to give a signal that said obstructing device has rotated out of said passage in said housing.

14. The device of claim 13, wherein:

said rotation of said cylinder beyond said point of sufficient alignment rotates said obstructing device back into said passage until the next bore in said cylinder presents itself in sufficient alignment with said passage in said housing to allow another object to be inserted.

15. The device of claim 12, wherein:

said obstructing device allows flow through said passage while obstructing said passage sufficiently to prevent an object from passing;

said cylinder comprising a flowpath therethrough separate from said bores retaining objects such that flow through said passage in said housing and through said flowpath can occur as said cylinder is rotated.

16. The device of claim 14, wherein:

said obstruction device comprises a rod-mounted flapper actuated by a cam;

said cylinder having a recess associated with each bore thereon so that when said sufficient alignment is reached, said cam can rotate into said recess to move said obstruction device out of said passage in said housing;

further rotation of said cylinder forces said cam out of said recess to rotate said obstruction device back into said passage in said housing.

17. A device for inserting at least one object into a wellbore, comprising:

a housing having a passage therethrough, said passage connectable to a wellbore for insertion of objects therein;

a retention device supported by said housing to hold at least one object to be inserted in the wellbore and to selectively position it in said passage of said housing for insertion into the wellbore;

said retention device holds a plurality of objects which can sequentially be sufficiently aligned with said passage in said housing for insertion into the wellbore;

said device further comprises a rotatably mounted member configured to separately retain the objects for insertion, such that rotation of said member sequentially brings successive objects in sufficient alignment with said passage in said housing to allow their insertion;

said member comprises a cylinder with multiple bores;

said cylinder is prevented from rotating in one direction;

said cylinder can be manually rotated;

said housing has an indexing feature which selectively prevents further rotation of said cylinder when a bore therein has achieved sufficient alignment with said passage to allow an object to pass, whereupon said indexing feature can be overridden to allow further cylinder rotation.

18. The device of claim 17, wherein:

said indexing feature comprises a biased pin on one of said cylinder and said housing which engages a stop on the other of said cylinder and said housing to signal said sufficient alignment.

* * * * *